US009828933B2

(12) United States Patent
Nagai et al.

(10) Patent No.: US 9,828,933 B2
(45) Date of Patent: Nov. 28, 2017

(54) ENGINE COOLER

(71) Applicant: KUBOTA Corporation, Osaka-shi, Osaka (JP)

(72) Inventors: Kentaro Nagai, Sakai (JP); Hideyuki Koyama, Sakai (JP); Hideyuki Goto, Sakai (JP); Takahiro Yamazaki, Sakai (JP); Hiroshi Kuwasaki, Sakai (JP)

(73) Assignee: KUBOTA Corporation, Osaka-shi, Osaka (JP)

( * ) Notice: Subject to any disclaimer, the term of this patent is extended or adjusted under 35 U.S.C. 154(b) by 98 days.

(21) Appl. No.: 14/633,317

(22) Filed: Feb. 27, 2015

(65) Prior Publication Data

US 2015/0267636 A1 Sep. 24, 2015

(30) Foreign Application Priority Data

Mar. 19, 2014 (JP) ..... 2014-056380

(51) Int. Cl.
*F02F 1/10* (2006.01)
*F02F 1/16* (2006.01)
(Continued)

(52) U.S. Cl.
CPC ..... *F02F 1/16* (2013.01); *F01P 3/02* (2013.01); *F02F 1/14* (2013.01);
(Continued)

(58) Field of Classification Search
CPC ..... F01P 3/02; F01P 2003/021; F02F 1/10; F02F 1/14; F02F 1/16
(Continued)

(56) References Cited

U.S. PATENT DOCUMENTS

2003/0230254 A1* 12/2003 Matsutani ..... F01P 3/02 123/41.79
2007/0028865 A1* 2/2007 Futakuchi ..... F02F 1/40 123/41.72
(Continued)

FOREIGN PATENT DOCUMENTS

DE 8628188 U1 12/1986
DE 10102644 C1 2/2002
(Continued)

OTHER PUBLICATIONS

Extended EP Search Report dated Jul. 17, 2015 in EP Application No. 15157340.9.
Office Action issued Aug. 1, 2017 in JP Application No. 2014-056380.
Examination Report issued Jul. 25, 2017 in EP Application No. 15157340.9.

*Primary Examiner* — Jacob Amick
*Assistant Examiner* — Charles Brauch
(74) *Attorney, Agent, or Firm* — Panitch Schwarze Belisario & Nadel LLP

(57) ABSTRACT

An engine cooler capable of suppressing a piston slap sound is provided. The engine cooler includes a cylinder block including a cylinder barrel and a water jacket, and a spacer stored in the water jacket, the water jacket surrounds the cylinder barrel, and the spacer encloses the cylinder barrel. Given that a width direction of the cylinder block is a lateral direction, a pressed member is pressed between the cylinder barrel and the spacer on lateral sides of the cylinder barrel, and a lower end of the pressed member is disposed above a lower end of each of right and left skirts of a piston located at a top dead center.

20 Claims, 5 Drawing Sheets

(51) Int. Cl.
*F02F 1/14* (2006.01)
*F01P 3/02* (2006.01)

(52) U.S. Cl.
CPC ..... *F01P 2003/021* (2013.01); *F02F 1/10* (2013.01); *F02F 2001/106* (2013.01)

(58) Field of Classification Search
USPC ..... 123/41.72
See application file for complete search history.

(56) References Cited

U.S. PATENT DOCUMENTS

| | | | | |
|---|---|---|---|---|
| 2008/0060593 | A1* | 3/2008 | Nakada | F01P 3/02 123/41.79 |
| 2008/0299854 | A1* | 12/2008 | Hilleary | A41D 31/0027 442/136 |
| 2009/0194046 | A1* | 8/2009 | Shikida | F02F 1/14 123/41.74 |
| 2011/0114042 | A1* | 5/2011 | Hamakawa | F02F 1/14 123/41.72 |

FOREIGN PATENT DOCUMENTS

| | | | |
|---|---|---|---|
| JP | 2002030989 | A | 1/2002 |
| JP | 2005201084 | A | 7/2005 |
| JP | 2007002822 | A | 1/2007 |
| JP | 2007127066 | A | 5/2007 |
| JP | 2007309221 | A | 11/2007 |
| JP | 2012-036741 | A | 2/2012 |
| KR | 20090063995 | A | 6/2009 |
| WO | 2008016127 | A1 | 2/2008 |

* cited by examiner

ENGINE COOLER

BACKGROUND OF THE INVENTION (1) Field of the Invention

The present invention relates to an engine cooler.

(2) Description of Related Art

A conventional engine cooler employs an open-deck structure in some cases in which the upper face of the water jacket is fully opened and thus, readily allows the piston slap sound to pass toward a cylinder head.

Problems

The piston slap sound readily occurs.

In such a cooler that employs the open-deck structure in which the upper face of the water jacket is fully opened, the piston slap sound readily passes toward the cylinder head, emitting the piston slap sound.

SUMMARY OF THE INVENTION

An object of the present invention is to provide an engine cooler capable of suppressing the piston slap sound.

Through studies, inventors of the present invention found that arrangement of a pressed member between the cylinder barrel and the spacer on lateral sides of the cylinder barrel can suppress the piston slap sound to device the present invention.

Matters specifying the invention according to the present invention are as follows.

An engine cooler includes a cylinder block having a cylinder barrel and a water jacket, and a spacer stored in the water jacket, the water jacket surrounds the cylinder barrel, and the spacer encloses the cylinder barrel, the engine cooler further includes a pressed member, given that a width direction of the cylinder block is a lateral direction, the pressed member is pressed between the cylinder barrel and the spacer on lateral sides of the cylinder barrel, and a lower end of the pressed member is disposed above a lower end of each of right and left skirts of a piston located at a top dead center.

The present invention has a following effect.

Effects

The piston slap sound can be suppressed.

The piston slap sound is suppressed. The reason can be assumed as follows: the piston slap sound caused near the lower ends of the right and left skirts by the oscillation of the piston is insulated by the pressed member and is hard to pass toward the cylinder head, suppressing the piston slap sound.

Effects

The backlash sound of the spacer can be eliminated.

The spacer is firmly fixed to the cylinder barrel via the pressed member, eliminating the backlash sound of the spacer.

BRIEF DESCRIPTION OF THE DRAWINGS

FIG. 4A is a plan view, FIG. 4B is a view viewed in the direction of an arrow B in FIG. 4A, and FIG. 4C is a view viewed in the direction of an arrow C in FIG. 4A; FIG. 5A is a sectional view of a first modification example, and FIG. 5B is a sectional view of a second modification example.

DETAILED DESCRIPTION OF PREFERRED EMBODIMENTS

FIG. 1 to FIG. 4C are views for illustrating an engine cooler in accordance with an embodiment of the present invention, and the engine cooler in this embodiment is a vertical serial two-cylinder diesel engine cooler.

This engine cooler will be summarized below.

Figure 1:
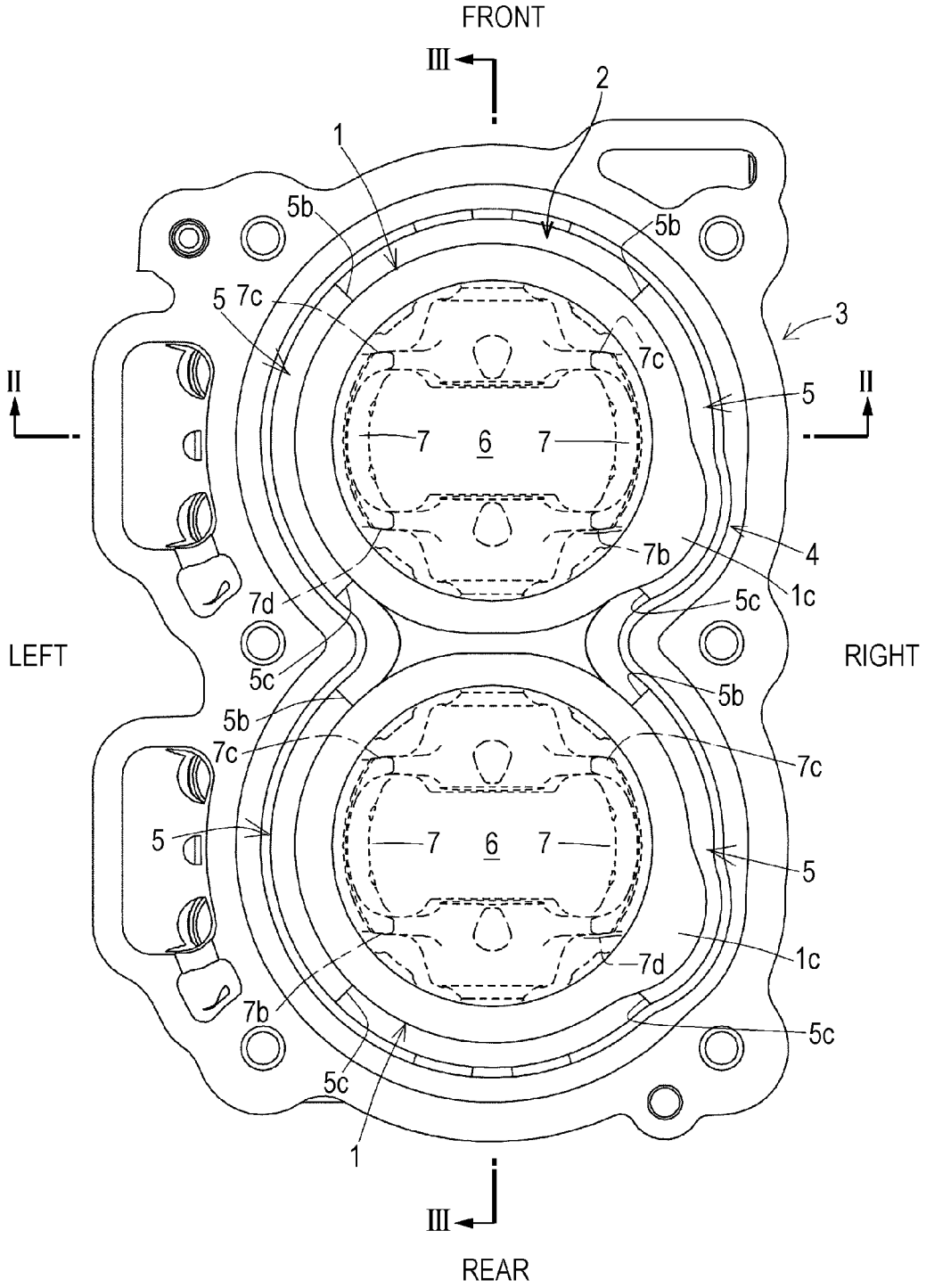
FIG. 1 is a plan view for illustrating an engine cooler in accordance with an embodiment of the present invention, which includes a cylinder block storing a spacer and a pressed member cylinder.
Figure 2:
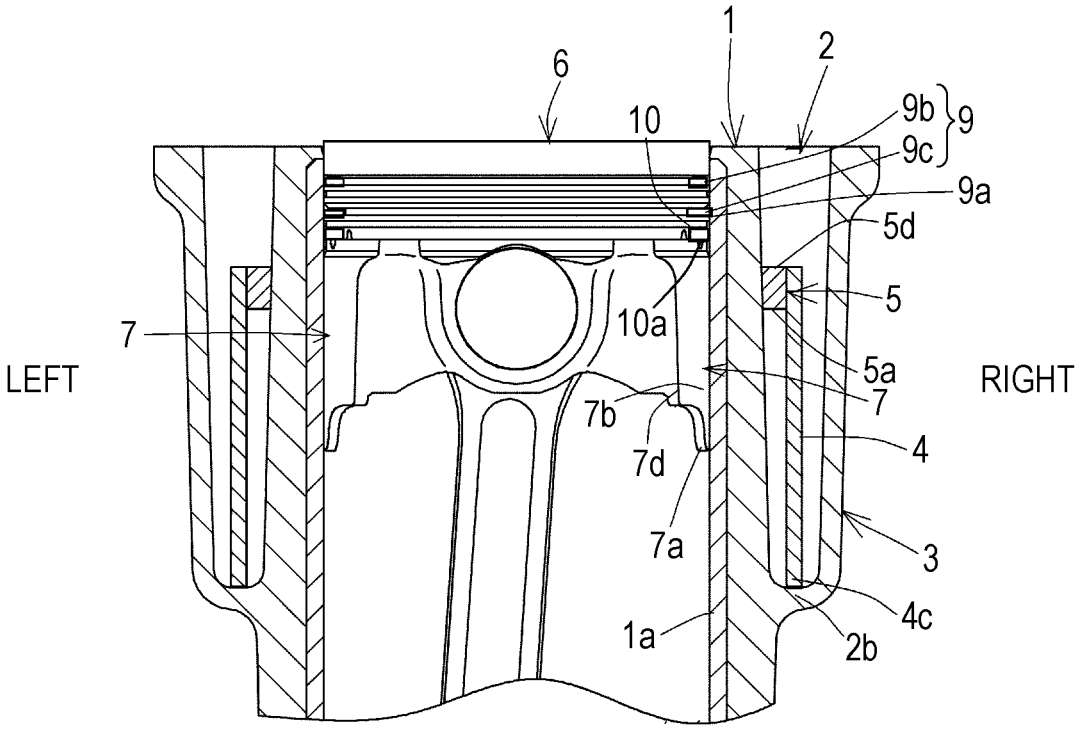
FIG. 2 is a sectional view taken along a line II-II in FIG. 1.
Figure 3:
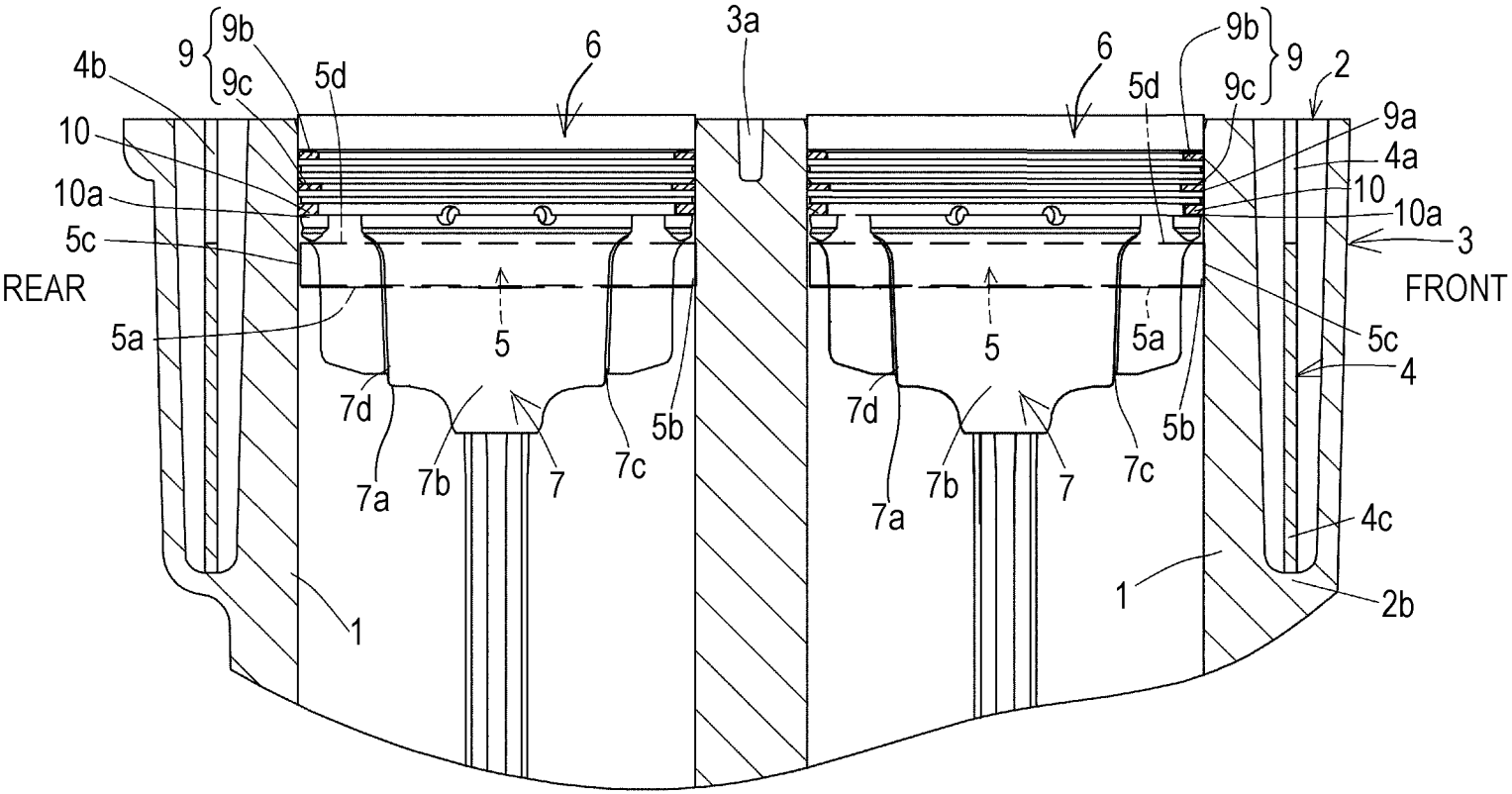
FIG. 3 is a sectional view taken along a line III-III in FIG. 1.

As shown in FIG. 1 to FIG. 3, the engine cooler includes a cylinder block (3) having a cylinder barrel (1) (1) and a water jacket (2), and a spacer (4) stored in the water jacket (2).

As shown in FIG. 1, the water jacket (2) surrounds the cylinder barrel (1) (1), and the spacer (4) surrounds the cylinder barrel (1) (1).

The cylinder block (3) is an aluminum die casting, and the inner circumferential face of the cylinder barrel (1) (1) is casted with an iron cylinder liner (1*a*). The water jacket (2) has an open-deck structure in which the upper side is fully opened.

An outward expanding section (1*c*) (1*c*) of the cylinder barrel (1) (1) is a strike plate of an injection hole cap (not shown) of an auxiliary chamber. A cooling-water introducing gap (3*a*) is provided in an upper part between cylinder bores.

As shown in FIG. 1 and FIG. 2, given that a width direction of the cylinder block (3) is a lateral direction, a pressed member (5) (5) is provided and the pressed member (5) (5) is pressed between the cylinder barrel (1) (1) and the spacer (4) on lateral sides of the cylinder barrel (1) (1).

As shown in FIG. 2 and FIG. 3, a lower end (5*a*) of the pressed member (5) is disposed above a lower end (7*a*) of each of right and left skirts (7) of a piston (6) located at a top dead center.

Therefore, the piston slap sound is suppressed.

The reason can be assumed as follows: the piston slap sound caused near the lower ends (7*a*) of the right and left skirts (7) by the oscillation of the piston (6) is insulated by the pressed member (5) and is hard to pass toward the cylinder head, suppressing the piston slap sound.

Further, the spacer (4) is firmly fixed to the cylinder barrel (1) (1) via the pressed member (5) (5), eliminating the backlash sound of the spacer (4).

As shown in FIG. 2 and FIG. 3, the lower end (5*a*) of the pressed member (5) is disposed above a piston maximum-diameter section (7*b*) of each of the right and left skirts (7) of the piston (6) located at the top dead center.

Therefore, the piston slap sound can be highly suppressed.

The reason can be assumed as follows. That is, a large slap sound caused near the piston maximum-diameter section (7*b*) by the oscillation of the piston (6) is insulated by the pressed member (5) and is hard to pass toward the cylinder head, suppressing the piston slap sound.

As shown in FIG. 1, given that a longitudinal direction of the cylinder block (3) which is perpendicular to a width direction of the cylinder block (3) when viewed in a plan is a front-rear direction, one side of the front-rear direction is front side and the other side of the front-rear direction is rear side, and as shown in FIG. 3, a front end (5*b*) of the pressed member (5) is disposed in front of a front end (7*c*) of each of the right and left skirts (7) of the piston (6) fitted in the cylinder barrel (1) pressing the pressed member (5), and a rear end (5*c*) of the pressed member is disposed in the rear of a rear end (7*d*) of the skirt (7).

Therefore, the effect of suppressing the piston slap sound is high.

The reason can be assumed as follows. That is, the piston slap sound caused near the front end (7*c*) of each of the right and left skirts (7) of the piston (6) by the oscillation of the piston (6) is insulated by the front end (5*b*) of the pressed member (5), which is located in front of the front end (7*c*) of the skirt (7), and is hard to pass toward the cylinder head and further, the piston slap sound caused near the rear end (7*d*) of each of the right and left skirts (7) of the piston (6) is insulated by the rear end (5*c*) of the pressed member (5), which is located in the rear of the rear end (7*d*) of the skirt (7), and is hard to pass toward the cylinder head. Therefore, the effect of suppressing the piston slap sound is high.

As shown in FIG. 2 and FIG. 3, an upper end (5*d*) of the pressed member (5) is disposed below a lower end (9*a*) of a pressure ring (9) of the piston (6) located at the top dead center.

Therefore, heat radiated from the pressure ring (9) can be prevented from being blocked by the pressed member (5).

As shown in FIG. 2 and FIG. 3, the upper end (5*d*) of the pressed member (5) is disposed below a lower end (10*a*) of an oil ring (10) of the piston (6) located at the top dead center.

Therefore, heat radiated from the oil ring (10) can be prevented from being blocked by the pressed member (5).

The pressed member (5) is made of an elastomeric resin. Specifically, the pressed member (5) is made of a urethane foam. The pressed member (5) may be made of rubber (including foamed rubber) in addition to a resin (including foamed resin). That is, the pressed member (5) just has to be made of a cushion material. Therefore, the effect of suppressing the piston slap sound is high. The reason can be assumed as follows: since the piston slap sound caused near the lower end (7*a*) of the skirt (7) of the piston (6) by the oscillation of the piston (6) is absorbed by the pressed member (5) made of the elastomeric resin or rubber, the effect of suppressing the piston slap sound is high.

The pressed member (5) is attached to the spacer (4). The attachment is performed by adhesion. Therefore, mere pressing the spacer (4) to which the pressed member (5) is attached to the water jacket (2) can pressingly sandwich the pressed member (5) (5) between the cylinder barrel (1) (1) and the spacer (4), thereby easily attaching the spacer (4) and the pressed member (5) (5) to the cylinder barrel (1) (1).

The spacer (4) is made of a resin. Specifically, the spacer (4) is made of nylon. The spacer (4) may be made of PPA (polyphthalamide). The spacer (4) may be made of rubber (for example, butyl rubber).

The spacer (4) may be made of a resin (including foamed resin), rubber (including foamed rubber), or a material obtained by forming a rubber layer (4*d*) on the surface of resin or a metal base material (4*c*). That is, the spacer (4) just has to be made of an acoustic absorption material. Therefore, the piston slap sound tends to be absorbed by the material of the spacer (4) and thus, the effect of suppressing the piston slap sound is high.

Figure 5A:
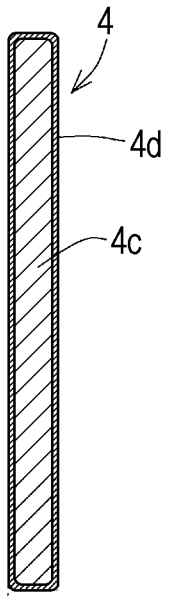
FIGS. 5A and 5B are views for illustrating modification examples of the spacer in FIG. 1.

FIG. 5A shows a first modification example of the spacer (4), in which a rubber layer (4*d*) made of soft rubber is formed on the resin base material (4*c*). The resin base material (4*c*) can be coated with the rubber layer (4*d*) by spray coating.

Figure 5B:
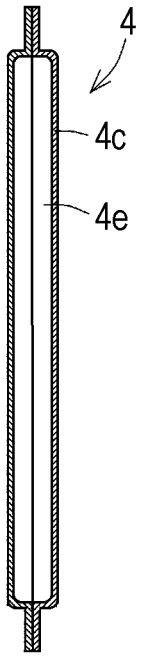

The spacer (4) can be constituted by forming a heat insulating layer (4*e*) in the base material (4*c*). Therefore, the heat retaining property of the cylinder barrel (1) (1) is high, increasing the warm-up speed at start of cooling. FIG. 5B shows a second modification example of the spacer (4), in which the air heat insulating layer (4*e*) is formed in the resin base material (4*c*).

Figure 4A:
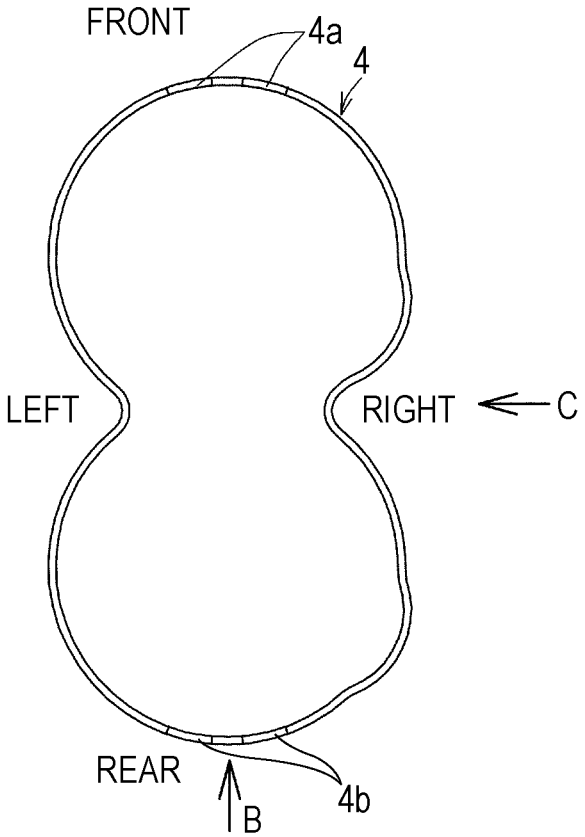
FIGS. 4A to 4C are views for illustrating the spacer in FIG. 1.
Figure 4C:
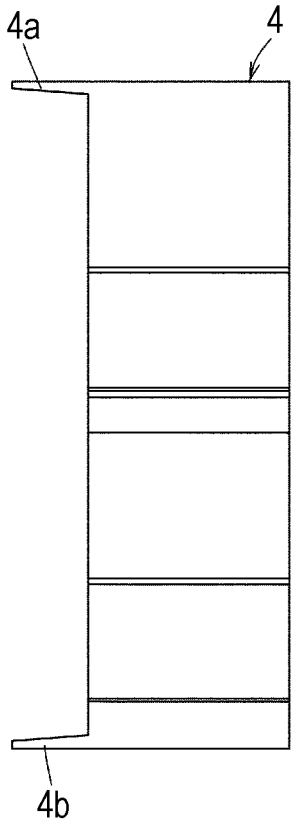
Figure 4B:
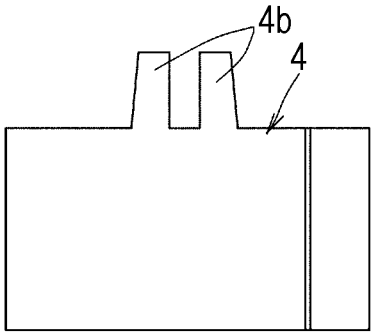

As shown in FIGS. 4A to 4C, the spacer (4) is provided with upward protrusions (4*a*) (4*b*) at front and rear ends, respectively, and as shown in FIG. 2, the lower end (4*c*) ofthe spacer (4) contacts an inner bottom (2*b*) of the water jacket (2), and upper ends of the protrusions (4*a*) (4*b*) contact the cylinder head (not shown) and are sandwiched between the inner bottom (2*b*) of the water jacket (2) and the cylinder head, such that the spacer (4) is vertically positioned.

What is claimed is:

1. An engine cooler comprising:

a cylinder block having a cylinder barrel and a water jacket with an inner bottom, and a spacer having an upper end and a lower end and being stored in the water jacket, the lower end of the spacer being engaged with the inner bottom of the water jacket, the water jacket surrounding the cylinder barrel, and the spacer enclosing the cylinder barrel, wherein the engine cooler further comprising a pressed member having an upper end, a top surface on the upper end, a lower end, a bottom surface on the lower end, and a pressed-member height extending from the top surface to the bottom surface, wherein the top surface is free from contact with any other body, and given that a width direction of the cylinder block is a lateral direction, the pressed member is stored in said water jacket and pressed between the cylinder barrel and the upper end of the spacer, with the upper end of the pressed member disposed no higher than the upper end of the spacer, on lateral sides on the cylinder barrel, the pressed-member height being less than a water-jacket width measured in the width direction of the cylinder block, and a lower end of the pressed member is disposed above a lower end of each of right and left skirts of a piston located at a top dead center.

2. The engine cooler according to claim 1, wherein the lower end of the pressed member is disposed above a piston maximum-diameter section of each of the right and left skirts of the piston located at the top dead center.

3. The engine cooler according to claim 1, wherein a front end of the pressed member is disposed in front of a front end of each of the right and left skirts of the piston fitted in the cylinder barrel pressing the pressed member, and a rear end of the pressed member is disposed in the rear of a rear end of the skirt.

4. The engine cooler according to claim 1, wherein an upper end of the pressed member is disposed below a lower end of a pressure ring of the piston located at the top dead center.

5. The engine cooler according to claim 4, wherein the upper end of the pressed member is disposed below a lower end of an oil ring of the piston located at the top dead center.

6. The engine cooler according to claim 1, wherein the pressed member is made of an elastomeric resin or rubber.

7. The engine cooler according to claim 1, wherein the pressed member is attached to the spacer.

8. The engine cooler according to claim 1, wherein the spacer is made of a resin, rubber, or a material including a base material and a rubber layer formed on the surface of the base material.

9. The engine cooler according to claim 1, wherein the spacer is made of a material having a heat insulating layer.

10. The engine cooler according to claim 2, wherein a front end of the pressed member is disposed in front of a front end of each of the right and left skirts of the piston fitted in the cylinder barrel pressing the pressed member, and a rear end of the pressed member is disposed in the rear of a rear end of the skirt.

11. The engine cooler according to claim 2, wherein an upper end of the pressed member is disposed below a lower end of a pressure ring of the piston located at the top dead center.

12. The engine cooler according to claim 3, wherein an upper end of the pressed member is disposed below a lower end of a pressure ring of the piston located at the top dead center.

13. The engine cooler according to claim 10, wherein an upper end of the pressed member is disposed below a lower end of a pressure ring of the piston located at the top dead center.

14. The engine cooler according to claim 11, wherein the upper end of the pressed member is disposed below a lower end of an oil ring of the piston located at the top dead center.

15. The engine cooler according to claim 12, wherein the upper end of the pressed member is disposed below a lower end of an oil ring of the piston located at the top dead center.

16. The engine cooler according to claim 13, wherein the upper end of the pressed member is disposed below a lower end of an oil ring of the piston located at the top dead center.

17. The engine cooler according to claim 2, wherein the pressed member is made of an elastomeric resin or rubber.

18. The engine cooler according to claim 4, wherein the pressed member is made of an elastomeric resin or rubber.

19. The engine cooler according to claim 10, wherein the pressed member is made of an elastomeric resin or rubber.

20. The engine cooler according to claim 11, wherein the pressed member is made of an elastomeric resin or rubber.

* * * * *